US009335780B1

(12) United States Patent
Granat et al.

(10) Patent No.: US 9,335,780 B1
(45) Date of Patent: May 10, 2016

(54) INPUT RANGE EXPANDER FOR POWER SUPPLIES

(71) Applicant: Lockheed Martin Corporation, Bethesda, MD (US)

(72) Inventors: Stanley M. Granat, Baldwinsville, NY (US); Jorge-Luis B. Romeu, Syracuse, NY (US); Russell S. Trask, Cicero, NY (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 514 days.

(21) Appl. No.: 13/735,302

(22) Filed: Jan. 7, 2013

(51) Int. Cl.
*G05F 5/00* (2006.01)

(52) U.S. Cl.
CPC ..... *G05F 5/00* (2013.01)

(58) Field of Classification Search
CPC ..... H02M 1/14; H02M 2001/007; G05F 5/00
See application file for complete search history.

(56) References Cited

U.S. PATENT DOCUMENTS

| | | | | |
|---|---|---|---|---|
| 4,564,767 | A | 1/1986 | Charych | |
| 5,479,333 | A | 12/1995 | McCambridge et al. | |
| 5,959,849 | A | 9/1999 | Batarseh et al. | |
| 6,055,167 | A * | 4/2000 | Shamkovich et al. | 363/52 |
| 6,181,084 | B1 | 1/2001 | Lau | |
| 6,194,880 | B1 | 2/2001 | Fraidlin et al. | |
| 6,215,261 | B1 * | 4/2001 | Becerra | 318/400.26 |
| 6,388,429 | B1 * | 5/2002 | Mao | 323/222 |
| 6,493,242 | B1 * | 12/2002 | Riggio et al. | 363/16 |
| 6,735,097 | B1 | 5/2004 | Prasad et al. | |
| 7,242,168 | B2 | 7/2007 | Muller et al. | |
| 7,514,907 | B2 | 4/2009 | Rajda et al. | |
| 7,596,006 | B1 * | 9/2009 | Granat | 363/39 |
| 2002/0145393 | A1 * | 10/2002 | Hui et al. | 315/224 |
| 2003/0102818 | A1 * | 6/2003 | Shen | 315/291 |
| 2003/0103366 | A1 * | 6/2003 | MacDonald et al. | 363/131 |
| 2008/0239771 | A1 * | 10/2008 | Wang et al. | 363/44 |
| 2008/0266228 | A1 | 10/2008 | Ueno | |
| 2008/0316779 | A1 * | 12/2008 | Jayaraman et al. | 363/74 |
| 2009/0295469 | A1 * | 12/2009 | DuBose | 327/544 |
| 2010/0020578 | A1 * | 1/2010 | Ryu et al. | 363/68 |
| 2010/0156509 | A1 | 6/2010 | Ryu et al. | |
| 2010/0206378 | A1 * | 8/2010 | Erickson et al. | 136/259 |
| 2011/0109245 | A1 * | 5/2011 | Lin et al. | 315/294 |
| 2011/0267851 | A1 * | 11/2011 | Nagel et al. | 363/37 |
| 2012/0091970 | A1 * | 4/2012 | Cho et al. | 320/160 |
| 2012/0113692 | A1 * | 5/2012 | Telefus et al. | 363/37 |
| 2012/0169313 | A1 * | 7/2012 | Lee et al. | 323/282 |
| 2012/0262113 | A1 * | 10/2012 | Sheu | 320/109 |
| 2012/0286663 | A1 * | 11/2012 | Puvanakijjakorn et al. | 315/85 |
| 2012/0313572 | A1 * | 12/2012 | Sheu | 320/107 |
| 2013/0062958 | A1 * | 3/2013 | Erickson et al. | 307/82 |
| 2013/0235631 | A1 * | 9/2013 | Pahlevaninezhad et al. | 363/126 |
| 2013/0308352 | A1 * | 11/2013 | Wu et al. | 363/39 |
| 2014/0009978 | A1 * | 1/2014 | Brinlee et al. | 363/25 |
| 2015/0002107 | A1 * | 1/2015 | Humphrey et al. | 323/205 |

* cited by examiner

*Primary Examiner* — Timothy J Dole
*Assistant Examiner* — Yusef Ahmed
(74) *Attorney, Agent, or Firm* — Howard IP Law Group, P.C.

(57) ABSTRACT

An electro-magnetic interference (EMI) filter having a boost mode amplifier integrated therewith is provided. The boost mode amplifier utilizes the filtering inductors of the EMI filter as energy storage devices to control the input voltage supplied to a DC-to-DC power converter. A controller is also provided for selectively activating the boost mode amplifier, maintaining the input voltage provided to the converter within a predetermined operating range.

13 Claims, 6 Drawing Sheets

INPUT RANGE EXPANDER FOR POWER SUPPLIES

FIELD OF THE INVENTION

The present disclosure relates generally to power supplies, and more specifically, to systems and methods for expanding the input voltage range of switched mode power supplies.

BACKGROUND

DC-to-DC switched mode power supplies or power converters are a common form of voltage regulator useful in a wide variety of applications, including radar systems. These power supplies are often designed for operation within a well-defined input voltage range. If a supply is operated below its low input voltage level design limit, it will draw increased current and can be irreversibly damaged. Likewise, input voltage levels exceeding an upper design limit can also damage the supply. Accordingly, safeguards are typically incorporated into these supplies to shut down their operation in the event that the input voltage to the supply falls above or below a predetermined input voltage threshold range.

Attempts to reuse existing supply designs in new applications are thus hindered when a specification for the new application requires continuous operation. For example, certain applications may require continuous operation, even during transient fluctuations in operating characteristics (e.g. transient input voltage changes) exceeding the safety shutdown limits of the supply. This requirement typically forces a redesign of the supply, or the sourcing of a replacement design. In either case, extensive rework and testing is required, increasing costs to prohibitive levels.

Accordingly, systems and methods are desired that provide a means to reuse existing DC-to-DC switched mode power supply designs when continuous operation during transient changes in input voltage is mandated by an application specification.

SUMMARY

In one embodiment of the present disclosure, an electromagnetic interference (EMI) filter having an integrated boost mode converter is provided. The EMI filter and boost converter are responsive to an input voltage source and configured to maintain an output voltage within a predetermined threshold range. The predetermined threshold range is selected according to a minimum and maximum input voltage threshold range of a power converter supplied by the input voltage source.

In one embodiment, the EMI filter comprises at least one inductor for filtering an input voltage, and the boost mode converter comprises a switching element operative to selectively charge and discharge the at least one inductor. A controller is operatively connected to the switching element and configured to measure the output of the at least one inductor. The controller selectively enables and disables the boost mode converter if a measured output voltage of the at least one inductor falls above or below a predetermined threshold.

A method of controlling an input voltage supplied to a power converter is also provided. The method includes the steps of filtering an input voltage supplied to the power converter with at least one inductor, and measuring the filtered input voltage. A comparison is made between the measured filtered input voltage and a predetermined voltage threshold. If the measured input voltage is below the predetermined voltage threshold, a boost mode converter is activated and operative to raise the input voltage supplied to the power converter.

DETAILED DESCRIPTION OF PREFERRED EMBODIMENTS

Figure 1:
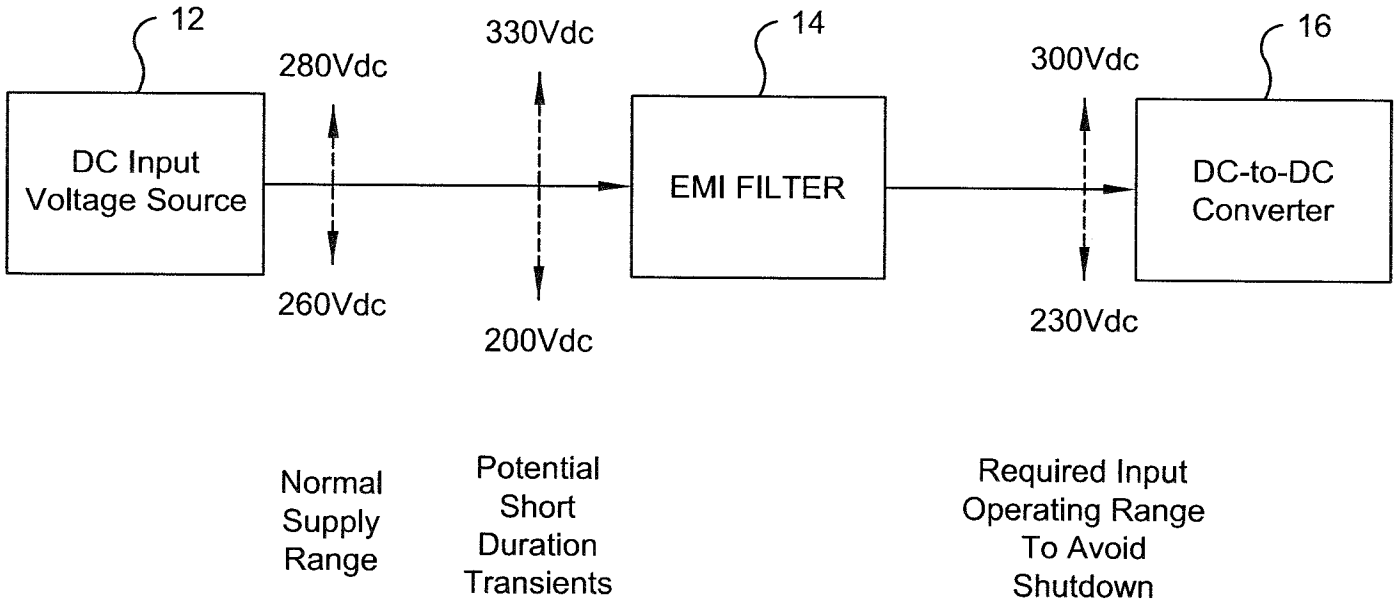
Fig. 1 (Prior Art)
FIG. 1 is a simplified schematic diagram illustrating a switched mode power converter and EMI filter arrangement according to the prior art.

It is to be understood that the figures and descriptions of the present invention have been simplified to illustrate elements that are relevant for a clear understanding of the present invention, while eliminating, for purposes of clarity, many other elements found in typical switched-mode power supplies and EMI filters. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Referring generally to FIG. 1, an exemplary power converter system is shown, including an input voltage source 12 operatively connected to a DC-to-DC power converter 16 for supplying power thereto. A typical implementation of power converter 16 into a system includes providing an EMI filter, such as EMI filter 14, between input voltage source 12 and the input of power converter 16. As will be understood by one of ordinary skill in the art, an EMI filter is typically a passive electronic device used to suppress interference present on a power or a signal line. These undesirable electromagnetic emissions can cause various levels of noise response, malfunctioning, and/or degradation in the performance of electronic devices.

In the illustrated embodiment, input voltage source 12 has a nominal output range of 260 Vdc to 280 Vdc supplied to power converter 16. However, the voltage from input voltage source 12 applied to power converter 16 may be subject to, for example, short-term (e.g. 50-100 ms) transient voltage levels falling outside of its nominal voltage range (e.g. 200 Vdc to 330 Vdc). These fluctuations in voltage supplied to power converter 16 may be problematic, as many DC-to-DC power converters are designed to operate within a well-defined input voltage range, for example, between 230 Vdc and 300 Vdc. As set forth above, safeguards, such as automatic shutdown limits, are typically incorporated into the power converter to prevent potential damage thereto by operating above or below its defined input voltage range. In the exemplary illustrated embodiment, power converter 16 would shut down if an input voltage supplied thereto fell outside of the 230 Vdc-300 Vdc operating range threshold. Accordingly, in applications where constant converter operation is required even in the event of these transient voltage spikes and drops, a redesigned or a replacement converter will be required. More specifically, an alternate power converter would have to be designed and implemented which is able to provide continuous, safe operation despite the fluctuations in input voltage.

Figure 2:
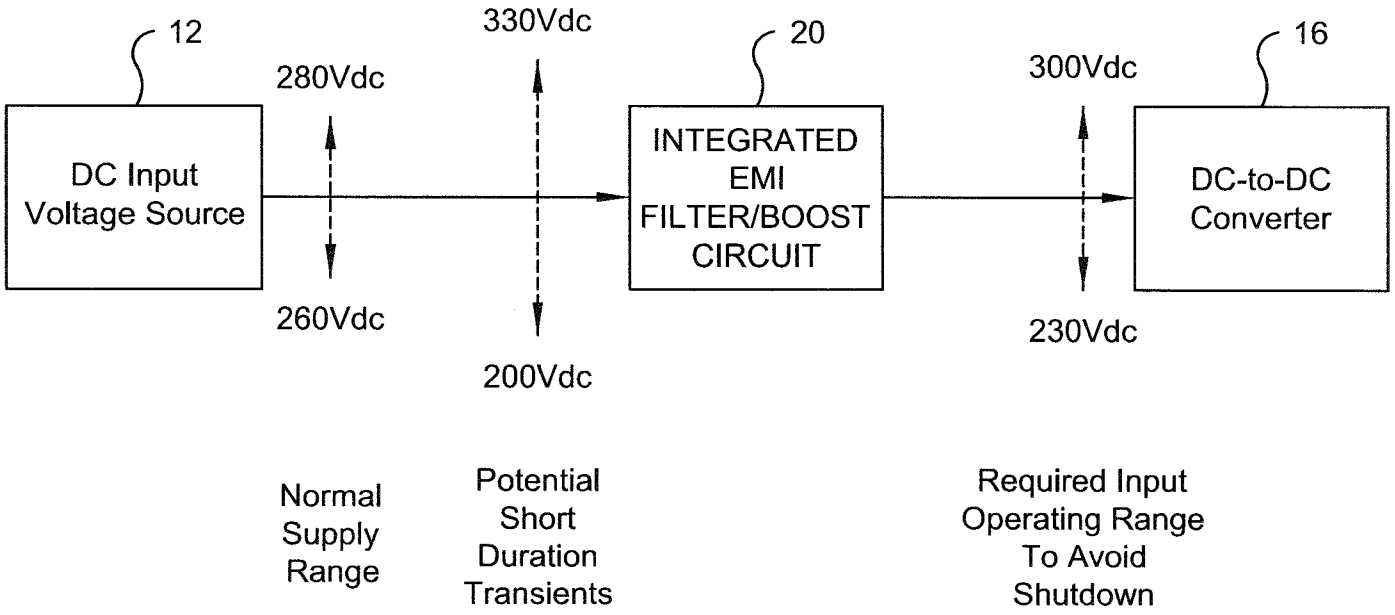
FIG. 2 is a simplified schematic diagram illustrating a switched mode power converter utilizing an integrated EMI filter and boost converter arrangement according to an embodiment of the present disclosure.

FIG. 2 illustrates an embodiment of the present disclosure, including a boost mode converter or amplifier installed between input voltage source 12 and the reused DC-to-DC power converter 16. In an exemplary embodiment, the boost amplifier utilizes the components of the EMI filter, creating an integrated EMI filter/boost amplifier circuit 20. The boost amplifier is used to alter the input voltage level provided to power converter 16 such that the input voltage is maintained within the operational input voltage range of power converter 16 (e.g. 230 Vdc-300 Vdc), despite encountering the above-described transient conditions. In this way, existing power converter designs may be reused in applications requiring continuous operation, and expensive, time-consuming redesign may be avoided.

Figure 3:
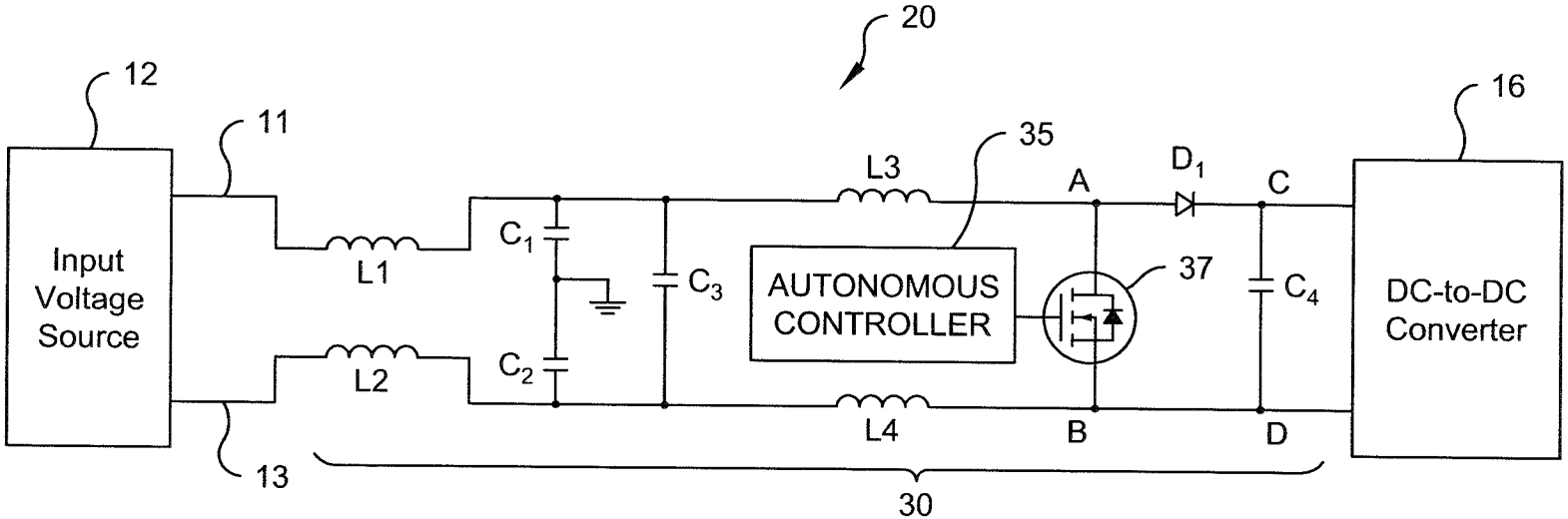
FIG. 3 is a circuit diagram of an exemplary integrated EMI filter and boost converter according to an embodiment of the present disclosure.

Referring generally to FIG. 3, exemplary integrated EMI filter/boost amplifier circuit 20 is shown in detail. As set forth above with respect to FIG. 2, integrated EMI filter/boost amplifier circuit 20 is responsive to input voltage source 12 for filtering input voltage provided to power converter 16. The circuit includes an EMI filter portion 30, comprising components operative to suppress both common-mode (line to ground) and differential-mode (line to line) interference. In particular, exemplary EMI filter 30 comprises common-mode inductors L1,L2 and differential-mode inductors L3,L4 arranged on an input line 11 and a return line 13 for blocking high-frequency interference. Capacitors C1,C2 are provided between input line 11 and return line 13 and are arranged in shunt for reducing common-mode noise. Differential-mode interference may be reduced by means of additional capacitors C3,C4 arranged between input line 11 and return line 13, as well as by inductors L1-L4.

Inductors L3,L4 of EMI filter 30 may be configured to provide functionality both in EMI filtering operations as set forth above, as well as for voltage range expansion according to embodiments of the present disclosure. In the illustrated embodiment, EMI filter 30 is supplemented with a switching device, such as transistor 37 (e.g. a FET, IGBT or BJT), a diode D1, and a controller 35 for utilizing inductors L3,L4 for energy storage as part of a boost mode amplifier arrangement.

The exemplary boost circuit of FIG. 3 may operate as follows: When transistor 37 is in a "closed" state a short circuit is created at nodes A,B and differential current flows through inductors L3,L4 which store energy from the current in a magnetic field. By "opening" transistor 37, the short circuit is removed, and the inductors will act as voltage sources in series with input voltage source 12, thereby increasing the voltage supplied to power converter 16. By rapidly cycling transistor 37 between open and closed states, the inductors do not fully discharge between charging states, and power converter 16 will see a voltage greater than that of input voltage source 12 alone. When transistor 37 is open, capacitor C4 in parallel with power converter 16 across nodes C,D is charged to the combined voltage of input source 12 and the inductors. When transistor 37 is closed, and power converter 16 is shorted from input voltage source 12, capacitor C4 will provide voltage to power converter 16. Blocking diode D1 prevents capacitor C4 from discharging through transistor 37. In this way, when the input voltage to power converter 16 remains sufficiently high, the inductors of EMI filter 30 can supply the required filtering. During transient periods, however, when the source input voltage drops to levels low enough to shut down power converter 16, the filter inductance can be driven as a boost inductor to raise the input voltage to within the operating range of power converter 16, thereby maintaining continuous converter operation and avoiding shutdown.

By way of non-limiting example, diode D1 may be implemented as a stand-alone device, or as the substrate diode of another transistor (e.g. a MOSFET). If implemented as a substrate diode of a transistor, the transistor may be operated continuously to lower series conduction losses until the boost mode operation is activated. During boost operation, the series connected transistor would be deactivated, permitting its substrate diode to function as a simple diode.

The boost amplifier, and more specifically transistor 37, is controlled independently of power converter 16 via controller 35. In one exemplary embodiment, controller 35 is operative to monitor (or measure) the voltage supplied at the input of power converter 16, and inhibit the circuit's operation as a boost amplifier (e.g. by placing transistor 37 in an "open" state) when the measured input voltage resides within a predetermined operating voltage range falling within the under-voltage and overvoltage shutdown limits of power converter 16. Input voltage measurements are monitored between nodes C and D. In this mode, the circuit functions as an input voltage EMI filter only. However, if controller 35 detects an input voltage at power converter 16 below a predetermined lower voltage limit that is above the under-voltage shutdown limit of power converter 16, the boost amplifier is activated, as set forth above, to raise the input voltage level into predetermined operating range. See, for example, FIG. 5, wherein a predetermined lower voltage limit 64 is set above a shutdown limit 60 of power converter 16.

Figure 5:
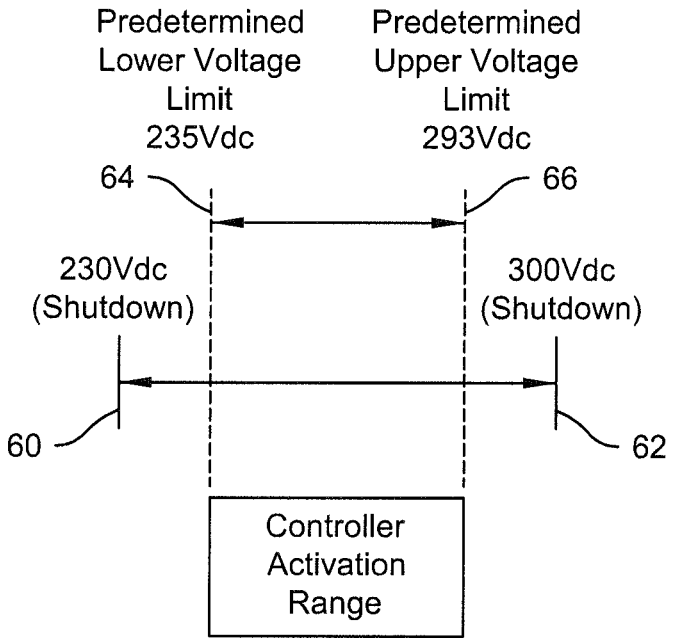
FIG. 5 is a diagram illustrating an exemplary predetermined operating range maintained by a boost converter controller as compared to the shutdown limits of an exemplary power converter according to embodiments of the present disclosure.

Still referring to FIG. 5, in the event that the boost amplifier operation raises the input voltage above a predetermined upper voltage limit 66 set below the overvoltage shutdown limit 62 of power converter 16, controller 35 will deactivate the boost function. During this boost disabled interval, power converter 16 will deplete the voltage on capacitor C4 until the input voltage drops below the predetermined lower voltage limit 64. This initiates another cycle which repeats until the input voltage rises to a level within the operating input range of converter 16 at which time the boost amplifier is deactivated.

Figure 4:
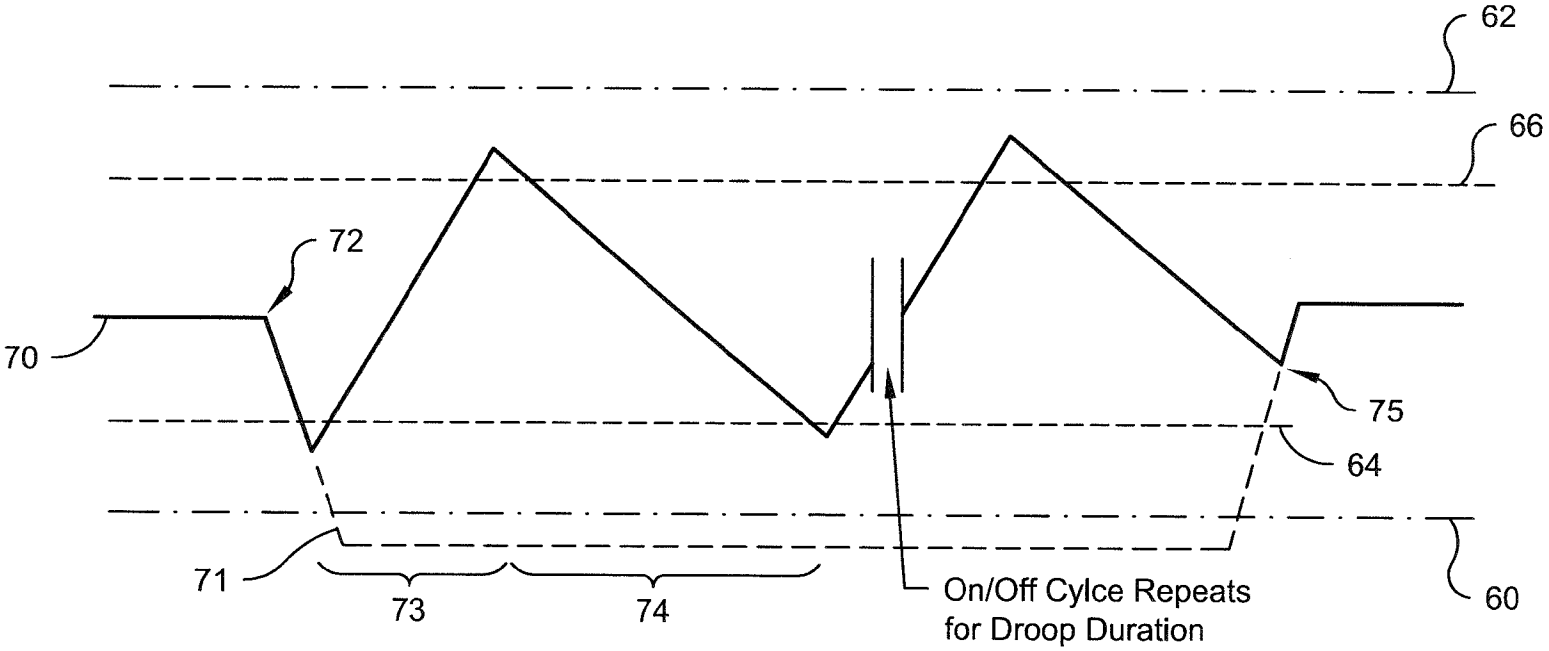
FIG. 4 is a diagram illustrating the operation of an integrated EMI filter and boost converter according to an embodiment of the present disclosure.

FIG. 4 provides a visual representation of the above-described operation of controller 35, and its effect on an input voltage provided to a power converter. As set forth above, controller 35 is operative to monitor a voltage 70 supplied to the input of a power converter, and disable the circuit's operation as a boost amplifier when the measured input voltage resides within the predetermined operating voltage range defined by predetermined lower voltage limit 64 and predetermined upper voltage limit 66, and falling within the under-voltage and overvoltage shutdown limits 60,62 of the power converter. In the event of a drop in the input voltage level (indicated at 72) below predetermined lower voltage limit 64, controller 35 is operative to active the boost amplifier for a period 73, until input voltage 70 is raised to the predetermined upper voltage limit 66. Once reached, controller 35 will deactivate the boost function for a period 74, until the input voltage drops below the predetermined lower voltage limit 64. This initiates another boost cycle. The on/off cycling of the boost amplifier will continue until the uncorrected input voltage 70 rises to a level within the predetermined operating range of converter 16 (indicated at 75) at which time the boost amplifier is deactivated. Trace 71 indicates an exemplary uncorrected input voltage level supplied by an input voltage source. As illustrated the boost amplifier is only in operation during a period wherein the uncorrected supplied input voltage 71 falls below predetermined lower limit 64. It should also be understood that the illustrated overshoots and undershoots of the predetermined threshold levels may occur due to circuit propagation delays. Accordingly, setting appropriate predetermined voltage limits may take into account these undershoots and overshoots, allowing a sufficient voltage buffer to ensure the shutdown limits 60,62 are not reached.

Figure 6:
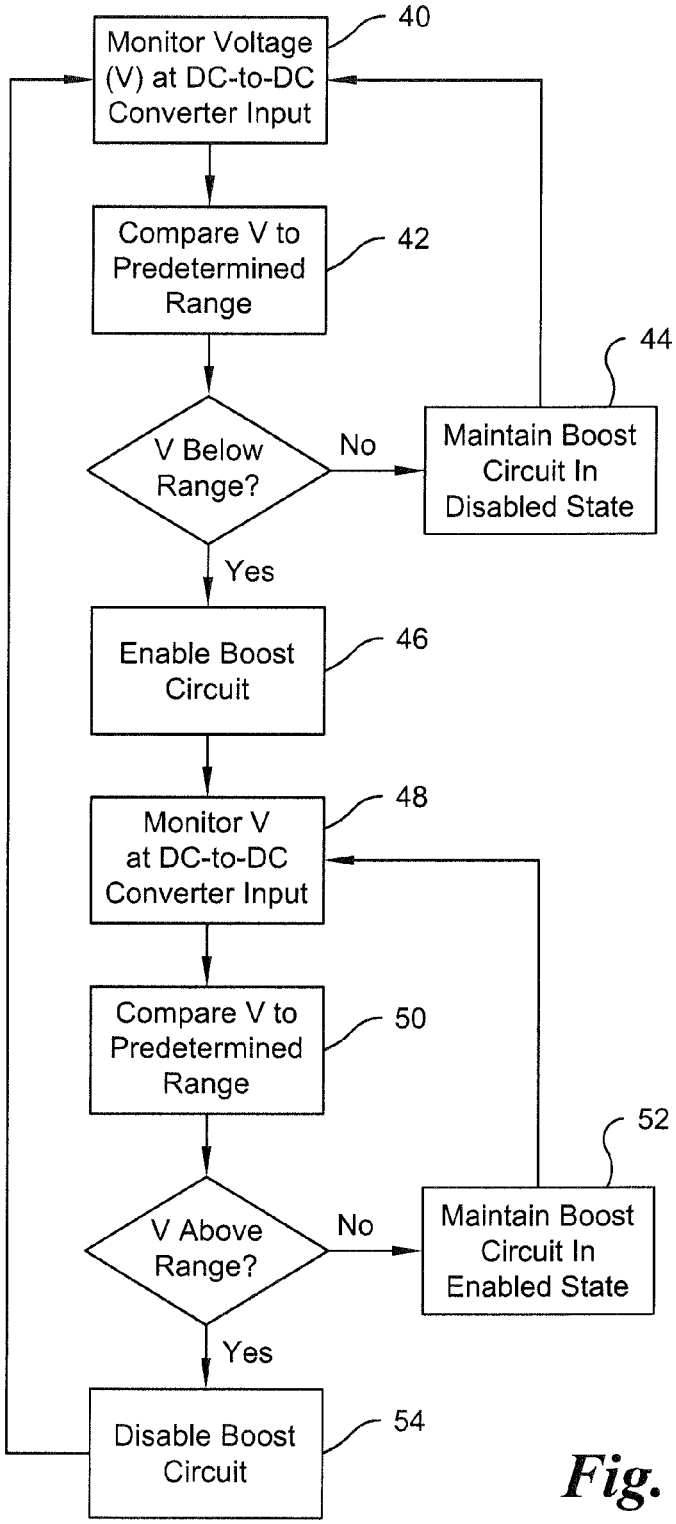
FIG. 6 is a process diagram of an exemplary method of maintaining an input voltage of a power converter within a predetermined range using an EMI filter and boost converter according to embodiments of the present disclosure.

FIG. 6 illustrates an exemplary control algorithm utilized by a controller (e.g. controller 35 of FIG. 3) for autonomous operation of the integrated EMI filter/boost amplifier circuit as set forth above. In step 40, the controller is operative to monitor the voltage supplied to the input of a power converter. A comparison of this monitored voltage to a predetermined, stored voltage range may be made in step 42. As set forth above with respect to FIG. 5, this predetermined range may include a lower limit or value that is set that is greater than the under-voltage shutdown limit of the power converter, and an upper limit or value that is set that is less than the overvoltage voltage shutdown limit of the power converter. If the measured voltage is determined to fall within or above the predetermined range, the controller will maintain the boost converter in a disabled state (off or transistor "open"), and continue monitoring the input voltage at the converter (step 44). It should be noted that the control algorithm may also comprise provisions for inhibiting the boost mode operation during an initial application of voltage (e.g. start-up), enabling boost mode operation only after the voltage reaches normal operating levels.

However, if the input voltage is detected to drop below the predetermined range, the controller will enable the boost converter in step 46 and input voltage supplied to the converter will be increased. The controller will continue monitoring the input voltage to the converter (step 48) and make comparisons to the predetermined range (step 50). If the input voltage has not risen above the predetermined range, the controller will continue monitoring the input voltage level with the boost converter activated (step 52). If the input voltage has risen beyond the predetermined range, however, the controller will disable the boost converter in step 54, and continue monitoring the input voltage level with the boost converter deactivated.

The embodiments are provided by way of example only, and other embodiments for implementing the methods described herein may be contemplated by one of skill in the pertinent art without departing from the intended scope of this disclosure. For example, control systems described herein, such as autonomous controller 35, may include one or more processors and memory containing data, which may include instructions, the instructions when executed by a processor or multiple processors, cause the steps of a method for performing the operations set forth herein. Software may be embodied in a non-transitory machine readable medium upon which software instructions may be stored, the stored instructions when executed by a processor cause the processor to perform the steps of the methods described herein. Any suitable machine readable medium may be used, including but not limited to, magnetic or optical disks, for example CD-ROM, DVD-ROM, floppy disks and the like. Other media also fall within the intended scope of this disclosure, for example, dynamic random access memory (DRAM), random access memory (RAM), read-only memory (ROM) or flash memory may also be used.

While the above-described embodiments and accompanying diagrams describe particular circuit devices, such as inductors, capacitors, diodes, and processor-based controllers, it is envisioned that these devices may be replaced with alternatives suitable to achieve the described desired function without departing from the scope of the present invention.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. An electromagnetic interference filter comprising:

a filtering circuit for filtering an input voltage comprising a first inductor arranged in series on an input voltage line and a second inductor arranged in series on a voltage return line;

a boost mode converter integrated into the filter, the converter comprising a switching element operative to selectively charge and discharge the first and second inductors; and a controller operatively connected to the switching element, the controller configured to measure an output voltage of the filtering circuit and enable the boost mode converter if the measured output voltage falls below a predetermined lower voltage limit and disable the boost mode converter if the measured output voltage rises above a predetermined upper voltage limit, wherein the predetermined upper voltage limit and lower voltage limit are selected to fall within an operating voltage range of a power converter supplied by the input voltage such that the controller is configured to prevent the shut down of the power converter.

2. The filter of claim 1, wherein the switching element comprises a transistor.

3. The filter of claim 1, wherein the switching element is arranged between the input voltage line and the voltage return line.

4. The filter of claim 1, further comprising a capacitor arranged between the input voltage line and the voltage return line.

5. The filter of claim 1, further comprising a diode arranged in series between the first inductor and an output of the filtering circuit.

6. The filter of claim 1, wherein the filter and an input voltage source are configured to be operatively connected to a DC-to-DC power converter.

7. The filter of claim 1, wherein the input voltage comprises a direct current (DC) input voltage, and the filtering circuit further comprises:

a third inductor responsive to the DC input voltage and arranged in series with the first inductor on the input voltage line, and a fourth inductor arranged in series with the second inductor on the voltage return line.

8. A method of controlling an input voltage supplied to a power converter comprising:

filtering an input voltage supplied to the power converter with a first inductor arranged in series on an input voltage line and a second inductor arranged in series on a voltage return line;

measuring the filtered input voltage supplied to the power converter;

comparing the measured filtered input voltage to a predetermined voltage threshold range defined by an upper voltage limit and a lower voltage limit; and activating a boost mode converter operative to raise the input voltage supplied to the power converter by selectively charging and discharging the first and second inductors if the measured input voltage is below the predetermined lower voltage limit, and deactivating the boost mode converter if the measured input voltage is above the predetermined upper voltage limit, wherein the predetermined voltage threshold range is selected to fall within an operating voltage range of the power converter such that the selective activation and deactivation of the boost mode converter is operative to prevent the power converter from shutting down.

9. The method of claim 8, wherein the step of selectively charging and discharging the first and second inductors comprises selectively opening and closing a switching device.

10. An electromagnetic interference filter responsive to an input voltage for supplying a filtered output voltage to a power converter comprising:

at least one inductor for filtering the input voltage;

a boost mode converter comprising a switching element operative to selectively charge and discharge the at least one inductor; and a controller operatively connected to the switching element, the controller configured to measure the output voltage of the filter supplied to the power converter and enable the boost mode converter if the measured output voltage of the filter falls below a predetermined non-zero threshold voltage, and disable the boost mode converter if the measured output voltage of the filter rises above the predetermined non-zero threshold voltage, wherein the threshold voltage is selected to fall within an operating voltage range of the power converter supplied by the input voltage such that the controller is configured to prevent the shut down of the power converter.

11. The filter of claim 10, wherein the threshold voltage comprises a voltage range defined by an upper voltage limit and a non-zero lower voltage limit.

12. The filter of claim 10, wherein the at least one inductor comprises a first inductor arranged in series on an input voltage line and a second inductor arranged in series on a voltage return line for suppressing differential-mode interference.

13. The filter of claim 12, further comprising a third inductor arranged in series with the first inductor, and a fourth inductor arranged in series with the second inductor for suppressing common-mode interference.

* * * * *